US005352148A

United States Patent [19]

Watkins

[11] Patent Number: 5,352,148

[45] Date of Patent: Oct. 4, 1994

[54] CONFETTI

[76] Inventor: James O. Watkins, 14920 Mt. Nebo Rd., Poolesville, Md. 20837

[21] Appl. No.: 51,355

[22] Filed: Apr. 23, 1993

[51] Int. Cl.[5] ..... A63H 33/30; A63H 27/00

[52] U.S. Cl. ..... 446/475; 446/34

[58] Field of Search ..... 446/475, 34; 428/7; 229/87.01, 87.05, 87.03; 342/12

[56] References Cited

U.S. PATENT DOCUMENTS

| | | | |
|---|---|---|---|
| 825,843 | 7/1906 | Kliemandt | 446/475 |
| 1,090,778 | 3/1914 | Clark | 446/475 |
| 1,122,421 | 12/1914 | Redington et al. | 446/475 |
| 1,153,207 | 9/1915 | Eisenberg | 446/475 |
| 1,491,809 | 4/1924 | Macchia | 446/475 |
| 1,663,679 | 3/1928 | Carpenter | 446/475 |
| 2,881,425 | 4/1959 | Gregory | 342/12 |
| 3,648,350 | 3/1972 | Cassidy et al. | 342/12 |
| 3,808,595 | 4/1974 | Coop et al. | 342/12 |
| 4,798,116 | 1/1989 | Silver et al. | 241/285.1 |
| 4,932,915 | 6/1990 | Boris et al. | 446/475 |
| 5,025,729 | 6/1991 | Cameron | 342/5 |

FOREIGN PATENT DOCUMENTS

| | | | |
|---|---|---|---|
| 458472 | 4/1928 | Fed. Rep. of Germany | 446/491 |
| 341784 | of 1931 | United Kingdom | 446/475 |
| 2250256 | 6/1992 | United Kingdom | 229/87.01 |

*Primary Examiner*—Robert A. Hafer
*Assistant Examiner*—Jeffrey D. Carlson
*Attorney, Agent, or Firm*—Ronald B. Sherer

[57] ABSTRACT

A form of confetti is disclosed in which each piece of confetti is shaped as an elongated rectangle such that it floats downwardly relatively slowly and with a distinctive fluttering motion. Bundles of such confetti, known under the trademark FLUTTER FETTI, are also disclosed with wrapping means whereby the bundles may be ejected into the air and the pieces of confetti burst from the bundle in a dramatic display of color and motion.

8 Claims, 3 Drawing Sheets

CONFETTI

BACKGROUND OF THE INVENTION

This invention relates to an amusement device, and more particularly to an improved form of confetti which enables the production of visual effects not previously obtainable with conventional confetti.

Standard or conventional confetti comprises a plurality of small, loose or bulk pieces of paper which are round or square, or scrap by product and which have diameters or lengths in the order of less than two inches, and usually less than one-half inch. When such confetti is thrown into the air, the pieces rise into the air as a stream, and then fall rapidly to the ground, sometimes with an irregular tumbling motion, but in generally straight, vertical paths from the highest point in the air reached by each piece. Such action is acceptable at weddings or parties where the object is to shower persons with the confetti. However, such action is not very dramatic or spectacular when the object is to create a visual display such as at an indoor fireworks show. First, there is no "burst" of color like real fireworks since the loose confetti must be thrown, or ejected from a toy cannon, such that there is a stream of confetti pieces rising into the air, as opposed to, a sudden burst of pieces from a single location in the air. Second, the individual pieces of conventional confetti fall to the ground in almost straight vertical lines, and they fall relatively rapidly, sometimes with an irregular tumbling motion, but with little or no floating action or "hang" time in the air.

SUMMARY OF THE INVENTION

The present invention provides a novel shape of confetti such that the individual pieces float and "flutter" as they fall toward the ground thereby doubling or tripling the hang time during which they are in the air. Further, the present invention provides for a large number of such individual pieces of confetti, such as several hundred or more than a thousand, to be releasably bound together as a bundle so that the bundle may be thrown or ejected into the air, and such that the bundle will suddenly burst into hundreds of individual pieces of confetti; each piece floating and fluttering relatively slowly to the ground, whereby an extremely dramatic and spectacular visual display may be achieved. Because of the unique fluttering action, confetti of the present invention is sometimes referred to herein by the trademark FLUTTER FETTI brand confetti.

DETAILED DESCRIPTION

Referring to FIGS. 1–4, the individual pieces 10, 12, 14, and 16 of the Flutter Fetti confetti of the present invention are cut from sheets of colored paper; Mylar being a trademark for plastic film. Mylar or other lightweight material; fireproof colored tissue paper is preferred for reasons of safety and ease of clean-up. Tissue paper is commercially available in thicknesses measured as eight-pound test to twenty-pound test. It has been determined that nine to twelve-pound test tissue paper, and most preferably ten-pound tissue paper, provides the most optimum combination of weight-to-stiffness such that the individual pieces of confetti either remain flat, or produce flapping ends, as they float, rotate, and slowly fall to the ground in these and other motions which will be more fully described hereinafter.

As further shown in FIGS. 1–4, the individual pieces 10, 12, 14, and 16 of Flutter Fetti confetti comprise various four-sided shapes hereinafter referred to generically as elongated rectangles. Each of the elongated rectangular shapes of pieces 10, 12, 14, and 16 has a length L, which may be in the order of one to seven inches, and a width W which is substantially smaller than length L, such as in the order of one-quarter inch to one inch. It has been found that the L/W ratio is important in order for each piece of confetti to float downward slowly, and with a maximum fluttering motion. In general, it has been found that the length-to-width ratio L/W should be between about 2.5 to 7, and preferably between 3.0 to 5.5, for maximum floating and fluttering action, and for maximum hang time in the air.

Figure 1:
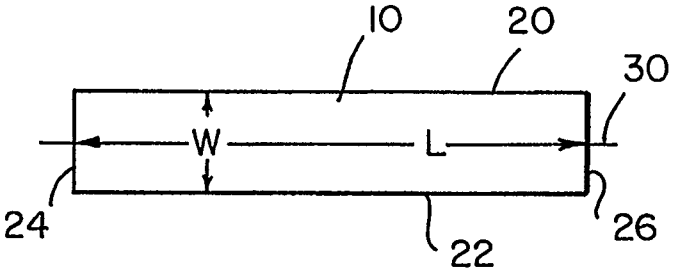
FIGS. 1–4 illustrate four specific shapes of Flutter Fetti confetti, each of such shapes being four-sided or tetragonal in shape.
Figure 2:
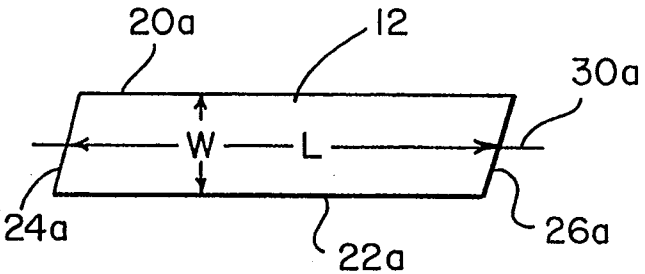
Figure 3:
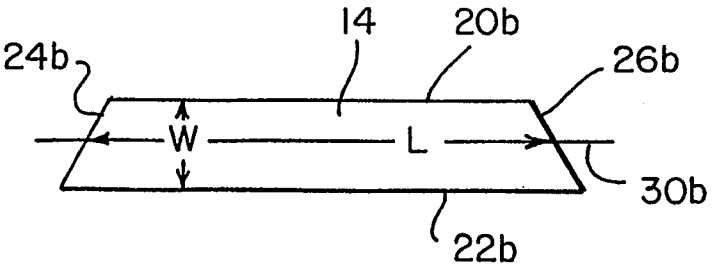
Figure 4:
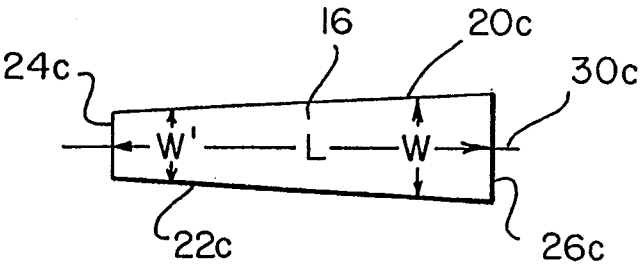

FIGS. 1–4 illustrate four preferred elongated tetragonal shapes which have been found to perform very well in terms of slowly floating downwardly with a maximum fluttering action. FIG. 1 illustrates a right-angled rectangle having elongated side edges 20, 22, and end edges 24, 26 and a longitudinal centerline 30. Similarly, as shown in FIGS. 2–4, Flutter Fetti pieces 12, 14, and 16 have elongated side edges 20*a, b, c* and 22*a, b, c,* end edges 24*a, b, c,* and 26*a, b, c,* and longitudinal centerlines 30*a, b, c.*

The elongated rectangular shape of Flutter Fetti piece 12 in FIG. 2 differs from the elongated rectangle of piece 10 in that end edges 24*a*, 26*a* are cut parallel to each other and at angles with respect to side edges 20*a*, 22*a* so as to form a parallelogram, while end edges 24*b*, 26*b* of piece 14 in FIG. 3 are cut on non-parallel lines so to form a trapezoid. Piece 16 in FIG. 4 is also a four-sided elongated tetragonal shape, however, it will be noted that side edges 20*c*, 22*c*, are cut along non-parallel lines so that width W′ of end edge 24*c* is smaller than width W of opposite end edge 26*c*. This shape, which may also be referred to as a truncated triangle, produces a particular pattern of movement as it descends as will be more fully explained hereinafter. However it will understood that each of the specific shapes elongated tetragonal shapes illustrated in FIGS. 1–4 produces a slow floating descent with unique fluttering action, and it will be apparent that others elongated tetragonal shapes are also possible within the presently discovered criteria that the piece of confetti be four sided, with sides and ends being of unequal dimensions, and with the L/W ratio being as previously disclosed.

Figure 5:
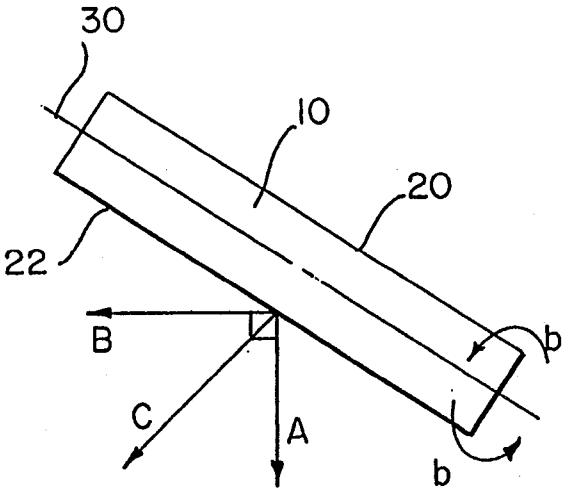

Reference is now made to FIG. 5 which is a perspective view 5 of piece 10 of Flutter Fetti confetti as it slowly descends downwardly in the direction of arrow A to the ground. When piece 10, or any of the above described pieces of elongated tetragonal shape are first freed in the air, the elongated tetragonal piece quickly assumes a horizontal position with the centerline 30 and side edges 20, 22 extending horizontally. That is, the piece does not drop with an end edge 24 or 26 leading in the downward direction of fall. Similarly, it does not fall with either of side edges 20, 22 leading downwardly in the direction of fall. Rather, the piece of Flutter Fetti confetti 10, 12, 14, or 16 first assumes a horizontal position, with centerline 30 and sides 20, 22 extending horizontally, and then, almost immediately, begins to rotate rapidly about its centerline as indicated by rotational arrows b-b while it continues to fall slowly with axis 30 remaining in a substantially horizontal position.

The detailed aerodynamic reasons for these particular motions are not fully understood, and the theory forms no part of the present invention. However, it is believed that these motions may result from the initial lift forces of the air being substantially equal on all portions of the surface of the piece, such that it initially assumes a horizontally extending position, and that thereafter slightly unbalanced forces, such as from slightly irregular edges or non-uniformity of the paper, cause the piece to rotate about its longitudinal axis. In any event, and regardless of the aerodynamic theory, it has been discovered that pieces of confetti having the above-indicated elongated tetragonal shape float to the ground relatively slowly with a long hang time in the air, and the rapid rotation of the pieces about their longitudinal centerlines appears to the eye of the observer as a rapid fluttering motion. This fluttering motion is quite distinctive, and creates a vivid visual impact, particularly when several hundred such pieces are fluttering downwardly simultaneously.

The falling motion of pieces 12 and 14 is essentially the same as that just described with respect to piece 10, and the general patterns of fall of pieces 10, 12, and 14 usually includes a component of horizontal motion as indicated by arrow B in FIG. 5. That is, as the pieces 10, 12, or 14 float generally downward toward the floor, as represented by vertical arrow A, they also move with a forward or horizontal, component of motion as represented by horizontal arrow B in which rotating side edges 20, 22 lead in the horizontal component of motion. Thus, the combined trajectory of fall becomes an angled descent of both forward and downward motion as represented by inclined arrow C. This forward or horizontal component of movement substantially increases the fall distance and adds substantial hang time to the fall of each piece in addition to the rotating fluttering motion which increases the floating action and decreases the rate of descent.

Figure 6:
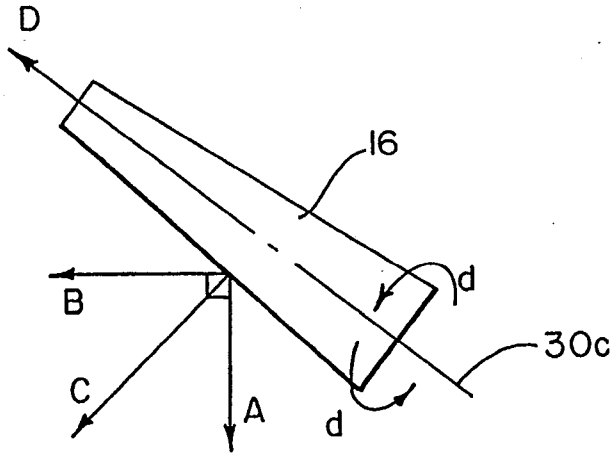
FIGS. 5-6 are perspective views of the FIG. 1 and FIG. 4 shapes of Flutter Fetti illustrating the falling motion of the individual confetti pieces.

The falling motion of pieces 16, previously described with reference to FIG. 4, includes the same fluttering, or rotational movement about centerline 30*c*, and the same forward and downward motion just described. However, in addition, the unequal end edges 24*c* and 26*c* cause piece 16 to abruptly move, or dart, sideways in the direction of arrow D. That is, elongated tetragonal pieces 16 of the truncated triangle shape of FIGS. 4 and 6 execute a second horizontal movement in which smaller edge 24*c*, which may be in the order of one-half to one-quarter of the width of larger edge 26*c*, leads the piece in a dramatic, sideways-darting movement represented by arrow D. Such sideways-darting movement may occur throughout the fall of piece 16, or the darting motion may stop and then begin again as the piece falls and flutters to the ground.

Figure 7:
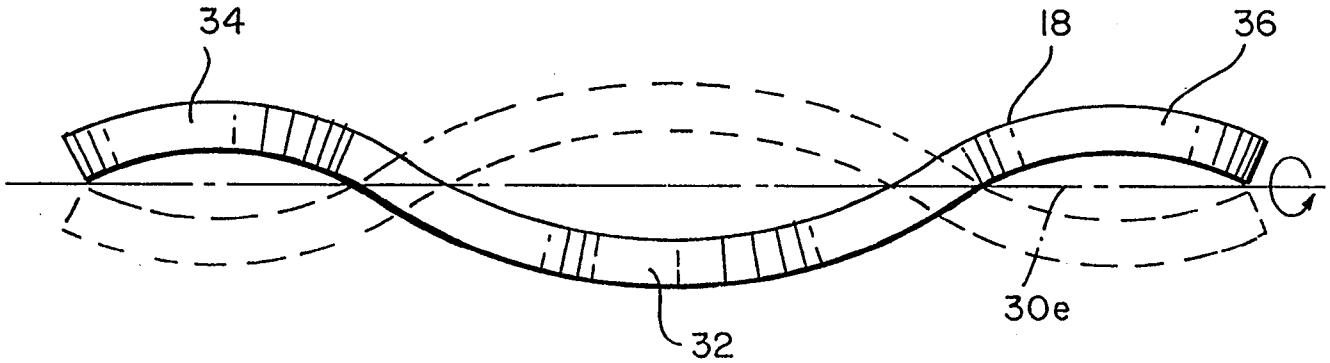
FIG. 7 is a perspective view of the falling motion of a further shape of elongated tetragonal confetti of the present invention.

In the foregoing description of the motions of pieces 10, 12, 14, and 16, it has been assumed that the length of the pieces are in the order of one to less than about five inches; two to three inches being a preferred length for maximum visual impact at reasonable cost. For, such lengths, the stiffness of the tissue paper is such that pieces 10, 12, 14, and 16 remain essentially flat, i.e. planar, as well as horizontal during their slow fluttering fall to the ground. However, if the pieces of Flutter Fetti confetti are made to be about five inches or greater, such as piece 18 shown in FIG. 7, the stiffness of the paper is not sufficient to maintain the elongated rectangular piece 18 in a flat or planar configuration. Instead, the piece 18 remains horizontal as it floats to the ground, but the center portion 32 drops relative to the end portions 34, 36, and the piece then rotates about a centerline 30*e* which is intermediate the vertical positions of the center 32 and end portions 34, 36. This causes the end portions 34, 36 to appear to rise and fall relative to the center portion 32, as shown in phantom line, and the piece of Flutter Fetti confetti appears to have a "flapping" bird-like motion while slowly floating to the ground.

As a result of the various sizes and shapes of elongated rectangular pieces 10, 12, 14, 16, and 18 described above, the overall effect of releasing several hundred to a thousand or more pieces of these combined shapes of Flutter Fetti confetti simultaneously is that the individual multi-colored pieces float, flutter, dart, and flap as they fall horizontally forward! y and downwardly thereby creating a spectacular display of color and motion.

Figure 8:
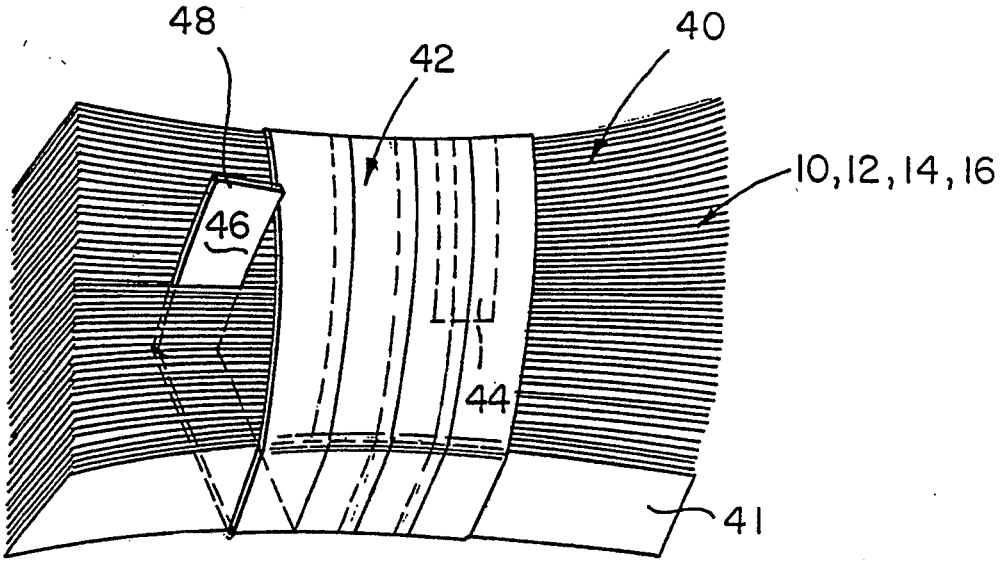
FIG. 8 is a perspective view of a wrapped bundle of multiple pieces of the Flutter Fetti confetti of the present invention.

Referring now to FIG. 8, a large plurality of pieces of Flutter Fetti confetti, such as several hundred or over a thousand, are illustrated as being formed in a bundle 40 with each piece being parallel to the other pieces, and all of the pieces lying face to face to form a stack; the outer face being indicated by numeral 41. The individual pieces may be all of the same specific shape, or they may be a mixture of shapes such as pieces 10, 12, 14, 16, and 18, or any combination of such shapes.

A wrapper 42 is wrapped several times about bundle 40 to secure all of the pieces in the stack. This may be accomplished by starting with an end 44 of the wrapper lying against the side of the bundle, or slipped into the bundle between two layers of the stack, and then winding wrapper 42 about the center portion of the stack so as to cover end 44 and thereby secure it in place the surface of the bundle and the overlying layers of the wrapping. One preferred method is to wind the wrapper about the center of the stack so as to slightly compress the center portion of the pieces against each other, while the ends of the pieces remain more loosely in contact with each other at the ends of the stack. After the stack is wrapped by one to fifteen layers of wrapping, the free end 46 of the wrapper may be slipped between the faces of two of the pieces, and the free end 46 may then be pulled upwardly beyond the top surface of the stack to form an exposed tab 48 as shown in FIG. 8. Because the pieces of confetti are slightly compressed near the center of the stack, end 46 is securely held between two compressed pieces such that wrapping 42 will not unravel so long as the tab 48 is not pulled out of the stack. Thus, the stack remains secured as a bundle 40 during handling and shipment prior to being launched into the air at a show. Alternatively, the free end or tab 48 may be secured to the upper layer of the wrapping by a small piece of adhesive tape which is later removed prior to launch.

Wrapping 42 may be composed of paper, but in one preferred embodiment, the wrapping is a ribbon of plastic or foil which is initially flat, and which has a "memory" to return to its flat condition while being wrapped about the stack. That is, the ribbon has a spring-like characteristic which urges the ribbon to Unwind and return to its flat condition. Therefore, when tab 48 is pulled out of the stack, or the piece of adhesive tape is removed, the stack may be thrown, or otherwise ejected as from a cannon by compressed air or $CO_2$ into the air as wrapped bundle 40. The bundle may be thrown or ejected 75 feet or more into the air before the wrapping of two to five layers becomes too loose to hold the pieces in the bundle, at which point, the spring-like ribbon completes its expansion about and away from the bundle, and this unwrapping action is promoted by the expansion of the compressed stack, such that the pieces are freed of the wrapping in a sudden release, and the colored pieces then burst in all directions in a dramatic display much like aerial fireworks. Alternatively, if the bundle 40 is wrapped with a ribbon of paper which does not have a memory to uncoil, the tumbling action of the bundle in the air effectively unwraps the ribbon so that the hundreds of pieces are suddenly freed in the burst of color. In either mode, the hundreds or thousands of pieces of Flutter Fetti confetti then begin their relatively slow, floating descent, while each piece appears to flutter as it rotates about its longitudinal axis, and while some pieces dart sideways or flap their ends like small, multi-colored birds.

In the embodiment just described, the bundle 40 is thrown or otherwise ejected into the air with tab 48 and wrapping end 46 loose, and with the tab and wrapping end rising in the air with the bundle as the wrapping of two to five layers begins to unravel as just described. In an alternative embodiment, tab 48 and loose end 46 of the wrapping may be retained; that is, held by the person throwing the bundle, such that the wrapping unwinds as the bundle tumbles in the air. In this embodiment, the number of layers of wrapping may be more in the order of five to fifteen wrappings such that the bundle tumbles in the air while the wrappings unwind at the free end of the ribbon and the opposite end of the ribbon is held by the thrower or secured to the cannon. When the number of wrappings is reduced to the last few layers, the slightly compressed pieces of confetti then burst out of the bundle in the same manner as previously described.

In another preferred embodiment of wrapping, bundle 40 may be wrapped by a single wrapped layer of paper or plastic ribbon, and the free end of the ribbon is secured to the wrapped layer by glue or adhesive tape. In this embodiment, the paper is selected to be of low tear-strength, such as tissue paper, and/or the amount of glue or adhesive tape is made sufficiently small such that, when the bundle 40 is thrown or otherwise ejected into the air and hits the ceiling of the room in which the indoor fireworks are being conducted, the force of the bundle hitting the ceiling ruptures the paper wrapping, and/or ruptures the seal of the glue or tape, with the result that the wrapping is suddenly and forcefully opened, and the hundreds of pieces of Flutter Fetti confetti in bundle 40 suddenly burst apart in the air and begin their colorful and motion-filled descent to the floor.

Figure 9:
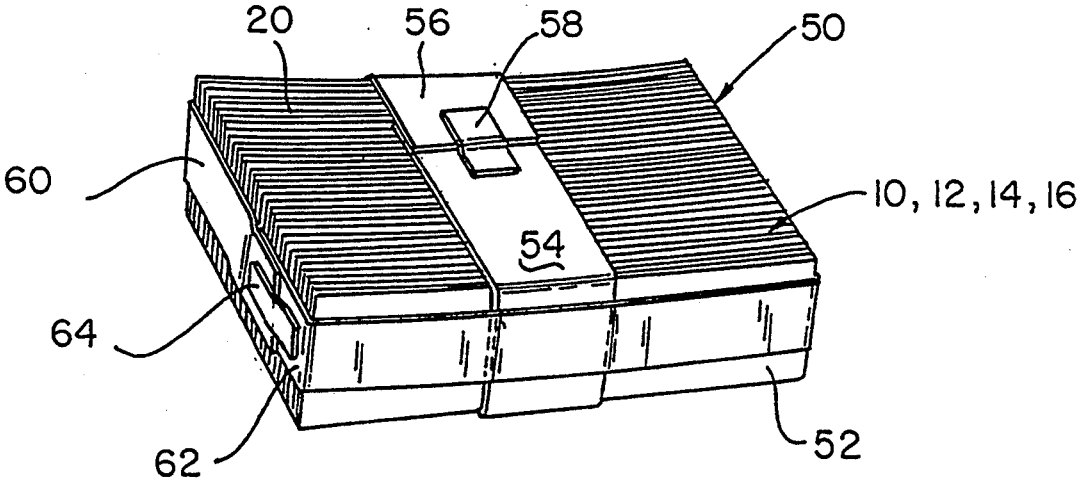
FIG. 9 is a perspective view of another embodiment of a wrapped bundle of multiple pieces of Flutter Fetti confetti.

In another preferred embodiment, as illustrated in FIG. 9, bundle 50 is double-wrapped in a manner which is particularly effective for being launched from a cannon by compressed air or sudden release of a $CO_2$ cartridge; such compressed air and $CO_2$ cannons being known per se. In this embodiment, a stack of pieces 10, 12, 14 and/or 16 is formed as in previously described bundle 40 with side edges 20 parallel to each other and faces 52 laying in face-to-face relationship. A first wrapper 54 is wrapped around the center portion of the bundle one or more times and the free end 56 is taped to the outer surface of wrap 54 by a piece of adhesive tape 58. A second wrapper 60 is wrapped one or more times around the ends and faces of the bundle and its free end 62 is taped to the outer surface of wrapper 60 by a piece of adhesive tape 64. Tape pieces 58, 64 remain in place during handling, storage and shipment, but are removed before the bundle 50 is loaded into the cannon. The wrappers 54 and 60 continue to hold the stack together as the bundle 50 is loaded into the cannon, and while the bundle is initially shot into the air. As the bundle continues to fly and tumble in the air, first wrapper 60 unwinds, followed by the unwinding of wrapper 54, and when the stack is released of both wrappers, the bundle bursts open and the pieces flutter and float downwardly and horizontally in a dramatic display as previously described.

From the foregoing description of several preferred embodiments of the present invention, it will be obvious to those skilled in the art of confetti making that numerous variations may be made in the specific shapes of confetti, and in various methods of launching such confetti, so as to produce dramatic displays of color and motion simulating actual fireworks. Accordingly, it is to be understood that the foregoing description is intended to be purely illustrative, rather than limiting, of the invention and that the legal scope of the invention is not to be limited other than as defined by the following claims and the doctrine of equivalents.

What is claimed is:

1. Amusement confetti means for injecting confetti upwardly into the air and creating an aerial display of confetti which flutters as it falls downwardly comprising:

a large plurality of flat, unconnected, individual pieces of confetti, each of said pieces of confetti having an elongated, tetragonal shape including a length, a width, a pair of faces and a longitudinal axis, said pieces having widths of substantially of one-quarter to one inch, said plurality of pieces being arranged with their longitudinal axes in parallel and with their faces in face-to-face relationship to form a stack of confetti pieces, and releasable wrapper means for releasing said stack of confetti pieces in the air, said releasable wrapper means extending around said stack to form a plurality of wrapped layers, said releasable wrapper means having first and second ends, said first end being covered by said wrapped layers and said second end being unsecured when said stack is injected into the air such that said releasable wrapper means unwraps in the air and releases said pieces of confetti to form an aerial display of confetti which flutters downwardly.

2. The amusement confetti means of claim 1 wherein said releasable wrapper means comprises a strip of lightweight material wrapped about said stack perpendicular to said longitudinal axes.

3. The amusement confetti means of claim 2 wherein said second end of said releasable wrapper means is positioned and held between two faces of a pair of pieces in face-to-face relationship prior to being injected into the air.

4. The amusement confetti means of claim 1 wherein said releasable wrapper means is composed of material having a memory to return to its unwrapped state such that in unwraps quickly in the air.

5. The amusement confetti means of claim 2 wherein said strip is wrapped about said stack sufficiently tightly to at least slightly compress said stack such that said stack bursts apart upon unwrapping of said wrapper means in the air.

6. Confetti amusement means for injecting confetti upwardly into the air for creating an aerial burst of confetti which flutters downwardly comprising:

a large plurality of flat, non-metallic unconnected pieces of confetti, each of said pieces of confetti having an elongated, tetragonal shape including a length, a width, a pair of faces and a longitudinal axis, said width being in the order of one-quarter to one inch, said length being in the order of 1–7 inches and the length to width ratio being in the order of 2.5–7, said plurality of pieces being in face-to-face relationship with their axes in parallel to form a stack, and releasable wrapper means wrapped about said stack to form at least one wrapping layer, said wrapper means being composed of lightweight material having a sufficiently low tear-strength so as to burst open and release said stack of pieces upon impact in the air with a solid structure.

7. The confetti amusement means of claim 6 wherein said releasable wrapper means is composed of tissue paper.

8. The confetti amusement means of claim 7 wherein said releasable wrapper means is composed of tissue paper of 9–12 pound test.

* * * * *